US005315773A

United States Patent [19]

Iwami et al.

[11] Patent Number: 5,315,773

[45] Date of Patent: May 31, 1994

[54] IRON RETRACTABLE IN STAND INCLUDING POWER AND WATER REGULATION THEREBETWEEN

[75] Inventors: Kenichi Iwami, Kobe; Kazuhisa Kawasaki, Kyoto; Seiichi Nakada, Sanda, all of Japan

[73] Assignee: Matsushita Electric Industrial Co., Ltd., Osaka, Japan

[21] Appl. No.: 34,632

[22] Filed: Mar. 22, 1993

Related U.S. Application Data

[63] Continuation of Ser. No. 809,904, Dec. 18, 1991, abandoned.

[30] Foreign Application Priority Data

| | | | |
|---|---|---|---|
| Dec. 26, 1990 | [JP] | Japan | 2-406508 |
| Jun. 3, 1991 | [JP] | Japan | 3-131364 |
| Aug. 20, 1991 | [JP] | Japan | 3-207863 |

[51] Int. Cl.[5] ..... D06F 75/12; D06F 75/28; H04B 3/06

[52] U.S. Cl. ..... 38/77.6; 38/107; 219/247

[58] Field of Search ..... 38/74, 75, 77.1, 77.3, 38/77.5-77.9, 79, 88, 103, 104, 106, 107, 142; 219/245-248, 250-252, 256, 257, 259; 150/165

[56] References Cited

U.S. PATENT DOCUMENTS

| | | | |
|---|---|---|---|
| 2,450,092 | 9/1948 | Reichold | 38/104 |
| 2,575,118 | 11/1951 | Pattison | 150/165 |
| 2,777,226 | 1/1957 | Finlayson | 38/77.6 |
| 2,864,185 | 12/1958 | Vance | 38/75 |
| 2,871,587 | 2/1959 | Jepson | 38/77 |
| 3,508,354 | 4/1970 | Stansbury et al. | 38/77.6 |
| 3,869,815 | 3/1975 | Bullock | 38/77.6 |
| 4,125,953 | 11/1978 | Colombo | 38/77.7 |
| 4,535,556 | 8/1985 | Cavalli | 38/77.6 |
| 4,565,019 | 1/1986 | Cavalli | 38/79 X |
| 5,074,066 | 12/1991 | Sakano et al. | 38/88 X |

FOREIGN PATENT DOCUMENTS

| | | | |
|---|---|---|---|
| 0124039 | 11/1984 | European Pat. Off. | 38/77.1 |
| 0131547 | 1/1985 | European Pat. Off. . | |
| 0225297 | 6/1987 | European Pat. Off. . | |
| 0311003 | 4/1989 | European Pat. Off. . | |
| 0315915 | 5/1989 | European Pat. Off. | 38/77.3 |
| 0379259 | 7/1990 | European Pat. Off. . | |
| 3208603 | 12/1983 | Fed. Rep. of Germany | 219/247 |
| 2461773 | 2/1981 | France . | |
| 2512473 | 3/1983 | France | 38/77.6 |
| 33-13196 | 8/1958 | Japan . | |
| 40-18239 | 6/1965 | Japan . | |
| 41-20639 | 10/1966 | Japan . | |
| 49-20273 | 5/1974 | Japan . | |
| 54-17879 | 7/1979 | Japan . | |
| 58-12700 | 1/1983 | Japan . | |
| 58-029498 | 2/1983 | Japan . | |
| 58-50999 | 3/1983 | Japan . | |
| 0071791 | 4/1984 | Japan | 38/77.1 |
| 0075092 | 4/1984 | Japan | 38/77.3 |
| 59-75099 | 4/1984 | Japan . | |
| 9000642 | 1/1990 | PCT Int'l Appl. . | |
| 0395917 | 1/1966 | Switzerland | 38/77.6 |

*Primary Examiner*—Clifford D. Crowder
*Assistant Examiner*—Ismael Izaguirre
*Attorney, Agent, or Firm*—Panitch Schwarze Jacobs & Nadel

[57] ABSTRACT

An ironing apparatus which includes an ironing head, an ironing head rest including an electrical connection for supplying an electrical current to the ironing head placed on the ironing heat rest, a main tank for containing water and supplying the water to the ironing head, a water supply unit for supplying the water into the main tank, a controller for controlling the water supply unit and a load detector for detecting the placement of the ironing head on the ironing head rest, wherein the water supply unit is driven in response to an input from the load detector in response to the placement of the ironing head on the ironing head rest, thereby supplying water to the ironing head. When the ironing head is no longer in use, it retracts into the ironing head rest and is protected by a movable housing which is opened and closed by an electric drive. When the iron is needed for use, the drive opens the cover and again exposes the ironing head which is raised in a tilted position with the front of the ironing head higher than the back of the ironing head.

19 Claims, 10 Drawing Sheets

IRON RETRACTABLE IN STAND INCLUDING POWER AND WATER REGULATION THEREBETWEEN

This is a continuation of U.S. patent application Ser. No. 07/809,904 filed Dec. 18, 1991, now abandoned.

BACKGROUND OF THE INVENTION

1. Field of the Invention

The present invention relates generally to an ironing apparatus for ironing clothing or the like, and more particularly, to an ironing apparatus which is self-contained.

2. Description of the Related Art

It is known that ironing takes time in preparation and tidying-up toil, like placing an ironing table, filling the tank with water, and removing the water after cooling. This is all extra work.

In order to reduce the preparatory and tidying-up burdens imposed on users, Japanese Utility Model Publication Nos. 33-13196, 40-18239 and 41-20639 propose an ironing apparatus which can be accommodated in the ironing table so as to simplify the preparation and tidying-up. However, the ironing table can not be cleared off and folded up, and is an obstruction on the floor.

U.S. Pat. No. 4,574,503, Japanese Patent Publication No. 54-17879 and Japanese Laid-Open Patent Publication No. 58-50999 propose other solution. The proposed ironing apparatus is provided with a small ironing table having collapsible legs so that the ironing apparatus as a whole can be stored in a tool shed or the like.

U.S. Pat. No. 2,777,226, No. 2,871,587, Japanese Patent Publication No. 49-20273 and Japanese Laid-Open Patent Publication No. 59-75099 disclose an apparatus which is provided with a separate large tank so as to eliminate the necessity of replenishing the water over a continued operation. However, the external connection between the apparatus and the separate tank hampers the mobility of the ironing apparatus, and this inconvenience trades off the merits of small size and lightweight.

Japanese Laid-Open Patent Publication Nos. 58-12700 and 58-29498 disclose an apparatus in which water is supplied upon placement of the body of the apparatus on a worktable.

The apparatus referred to above has the following disadvantages:

First, after the ironing is finished, a mat, a covering cloth and others spread on the ironing table must be cleared off, and then the worktable is folded up. This tidying-up is toilsome, and the merit of portability is offset. Before starting the ironing, the operator must unfold the folded ironing table. Furthermore, the ironing apparatus must have a tank large enough to reduce the frequency of replenishing the water. The provision of a large tank increases the size of the ironing apparatus, thereby lacking handiness and portability.

Second, a water supply pipe is connected to the ironing apparatus at an out-of-sight place, and the pipe often becomes disconnected owing to the reciprocal movements of the ironing head. When the disconnection occurs, the user tends to overlook it because of the out-of-sight place where it occurs. In addition, the user must be constantly careful about the connection between the water pipe and the plug.

SUMMARY OF THE INVENTION

The ironing apparatus of this invention, which overcomes the above-discussed and numerous other disadvantages and deficiencies of the prior art, comprises an ironing head, an ironing head rest including an electrical connection for supplying an electric current to the ironing head placed on the ironing head rest, a main tank for containing water and supplying it to the ironing head, a water supply unit for supplying the water into the main tank, a control means for controlling the water supply unit and a load detection means for detecting the placement of the ironing head on the ironing head rest, wherein the water supply unit is driven in response to an output from the load detection means that generates in response to the placement of the ironing head on the ironing head rest, thereby supplying water to the ironing head.

In a preferred embodiment, the ironing head comprises a sub-tank and a water volume detection means for detecting the amount of the water in the sub-tank, water being supplied by the water supply unit driven in response to an output from the water volume detection means that generates in response to the placement of the ironing head on the ironing head rest, the water supply unit being stopped in response to a signal from the water volume detection unit when the sub-tank is filled with a predetermined amount of the water.

In a preferred embodiment, the ironing head comprises a first valve for opening and closing a first opening formed therein, and the ironing head rest comprises a second valve for opening and closing a second opening formed therein opposite to the first opening, the first and second valves effecting the connection and disconnection between the ironing head and the water supply means, wherein the placement of the ironing head on the ironing head rest operates the first valve thereby opening the first opening and then operating the water supply valve thereby opening the second opening, and wherein the dismounting of the ironing head from the ironing head rest effects the closing of the second opening and then closing the first opening.

In a preferred embodiment, the ironing head comprises a temperature control means, a thermal sensor for detecting a temperature thereof so as to enable the control means to control the energizing of the ironing head in response to an output from the thermal sensor, and a thermal setting means for setting the temperature of the ironing head so as to operate the water control means in response to an output from the thermal setting means.

In a preferred embodiment, the water in the ironing head is returned into the main tank by the water supply unit driven in response to an output from the thermal setting means when the ironing head is deenergized by the thermal setting means.

In a preferred embodiment, the ironing apparatus includes a timer for measuring time from the moment when the ironing head is placed on the ironing head rest so that upon the lapsing of a predetermined time the ironing head is deenergized, and this enables the water supply unit to return the water in the sub-tank into the main tank.

In a preferred embodiment, the ironing head rest comprises an electric connection for supplying electric current to the ironing head, a housing for housing the ironing head, a housing cover for covering the ironing head housed in the housing, wherein the housing cover comprises two portions capable of being opened and closed by an electric drive mechanism.

In a preferred embodiment, the ironing apparatus includes a current control means for controlling a current supply to the ironing head in response to an output from the thermal detection means, and a thermal setting means for setting the temperature of the ironing head to a desired value, thereby operating the electric drive mechanism in response to an output from the thermal setting means.

In a preferred embodiment, the ironing apparatus includes a timer for measuring time from the moment when the ironing head is placed on the ironing head rest so that upon lapsing of the time set by the timer a current supply is interrupted to the ironing head, and the ironing head is housed in the housing by the operation of the electric drive mechanism.

In a preferred embodiment, the ironing head rest descends and ascends by the electric drive mechanism, the descent and ascent of the ironing head rest being linked with the movement of the housing cover.

In a preferred embodiment, the ironing head is raised in a tilted position with its front portion higher than the rear portion, and is lowered in a horizontal position so as to be housed in the housing.

In a preferred embodiment, the ironing apparatus includes a switch for stopping the current supply to the ironing head in response to the housing thereof in the housing, and starting the current supply to the ironing head in response to the dismounting thereof from the ironing head rest.

Alternatively, the ironing apparatus comprises an ironing head, an ironing head rest for supplying an electric current to the ironing head placed thereon, a main tank for containing water for the ironing head, a water supply unit for supplying the water from the main tank to the ironing head, a load detection means for detecting the placement of the ironing head on the ironing head rest, a control means for controlling the water supply to the ironing head by the water supply unit driven in response to an output from the load detection means, a housing for housing the ironing head, a housing cover for covering the ironing head housed in the housing, and a housing unit for housing the ironing head in the housing in response to the operation of the electric drive mechanism for closing and opening the housing cover.

In a preferred embodiment, the ironing head rest descent and ascent is driven by the electric drive unit, the descending and ascending movements of the ironing head rest being linked with the opening and closing of the housing cover.

Alternatively, the ironing apparatus comprises an ironing head, an ironing head rest for supplying an electric current to the ironing head placed thereon, a main tank for containing water for the ironing head, a water supply unit for supplying water from the main tank into the ironing head, a load detection means for detecting the placement of the ironing head on the ironing head rest, a control means for controlling the water supply to the ironing head by the water supply unit driven in response to an output from the load detection means, a housing for housing the ironing head, a housing cover for covering the ironing head housed in the housing, a housing unit to house the ironing head in the housing in response to the operation of the electric drive mechanism, and an ironing table on which ironing is carried out.

Thus, the invention described herein makes possible the objectives of (1) providing an ironing apparatus of a small size which ensures the supply of water to the ironing head, (2) providing an ironing apparatus which ensures the safe housing of the ironing head, and (3) providing an ironing apparatus which is convenient to use with the minimum preparation and tidying-up toil.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
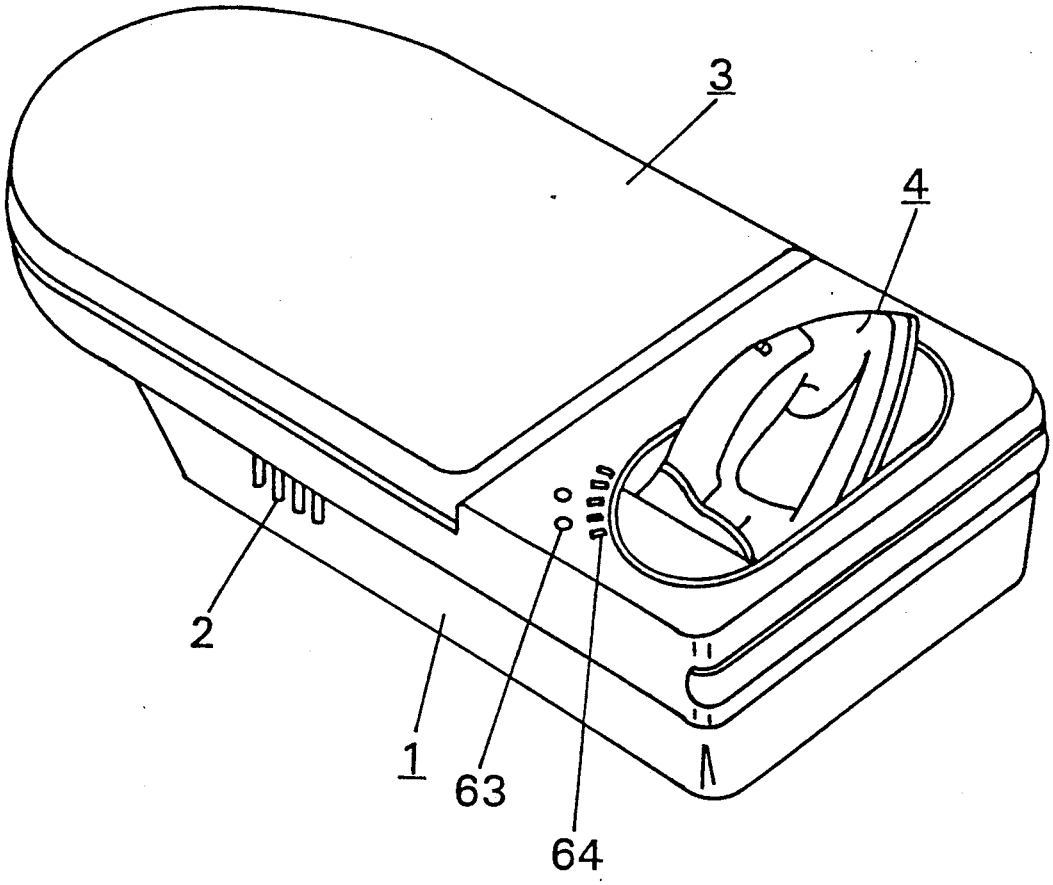
FIG. 1 is a perspective view showing an example of the ironing apparatus according to the present invention.
Figure 2:
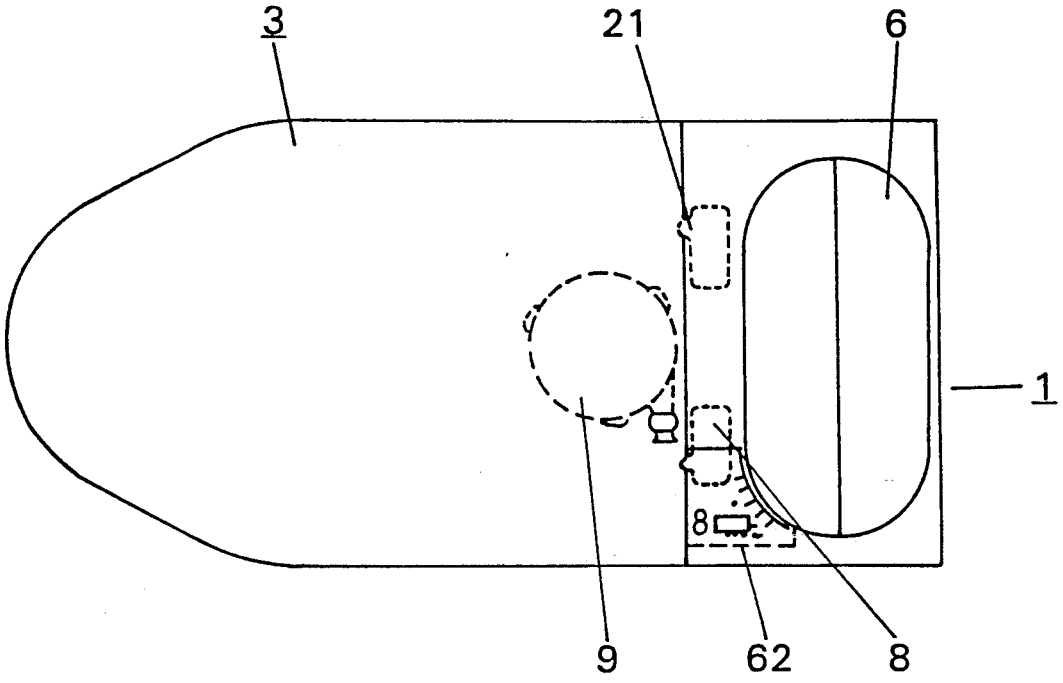
FIG. 2 is a plan view of the ironing apparatus of FIG. 1.
Figure 3:
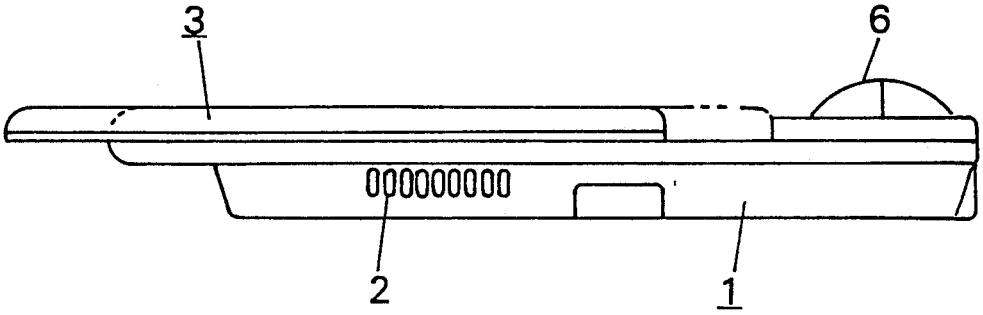
FIG. 3 is a side view of the ironing apparatus of FIG. 1.
Figure 4:
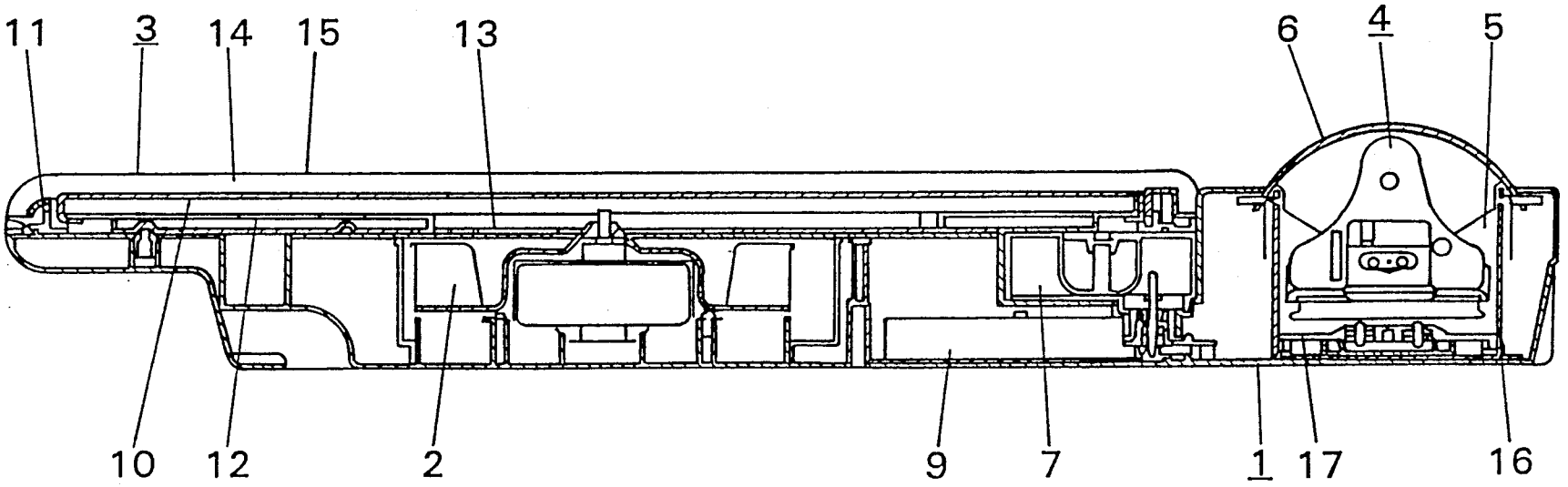
FIG. 4 is a cross-sectional view of the main part of the ironing apparatus of FIG. 1.
Figure 5:
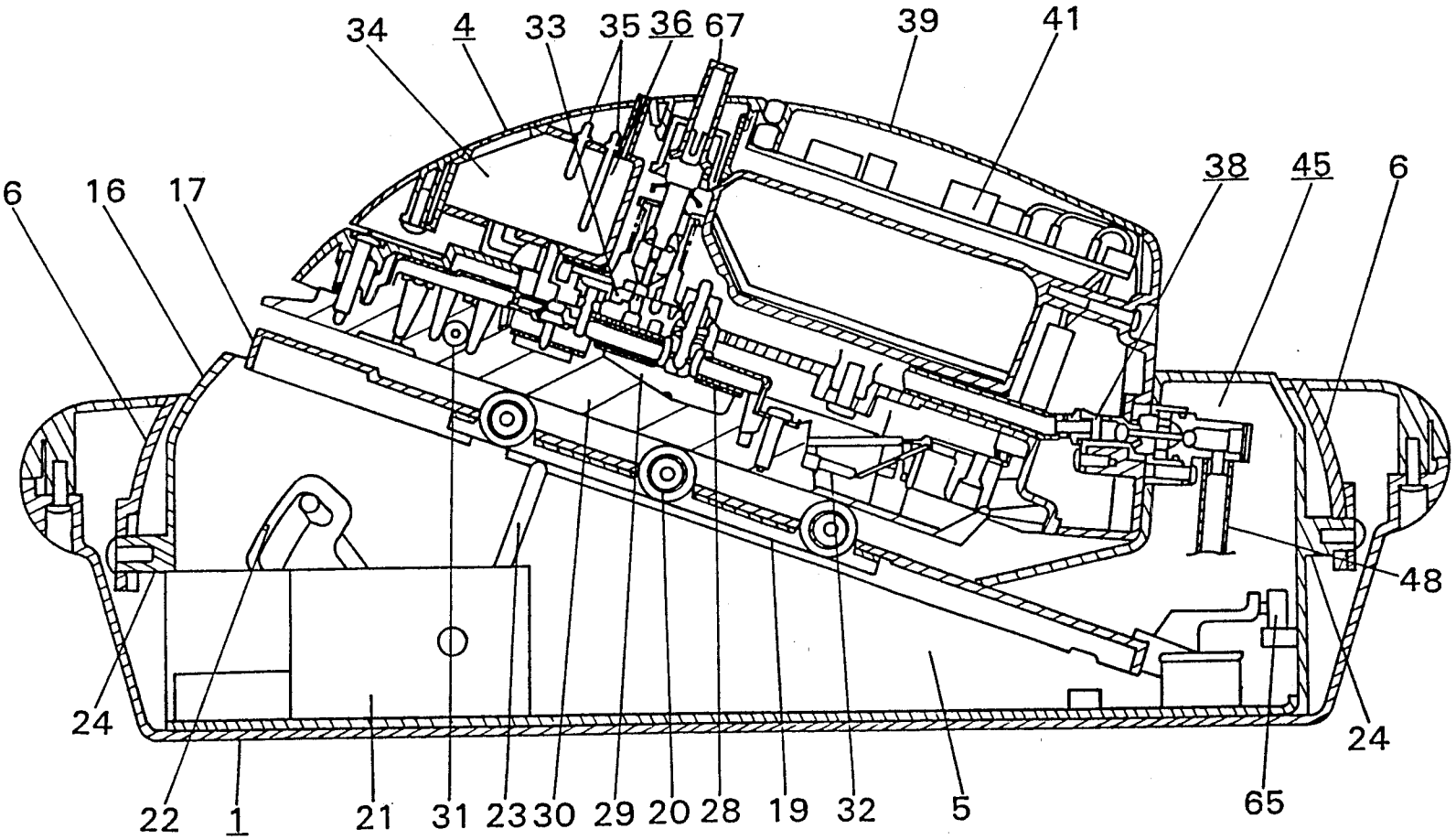
FIG. 5 is a cross-sectional view of the main part of the ironing head shown in FIG. 1.

Referring to FIGS. 1 to 11, a main body 1 comprises an exhaust fan 2, a worktable 3, a housing 5 in which an ironing head 4 is housed, a housing cover 6, a main tank 7, a water supply unit 8, and a cord take-up roller 9.

The worktable 3 includes an ironing board 11 covered with a permeable medium such as net, and a cover 12 covering the undersurface of the ironing board 11. The cover 12 is fixed to the ironing board 11 in an airtight manner, and is provided with an exhaust hole 13 at the center connected to the exhaust fan unit 2 in an airtight manner. The worktable 3 is fixed to the upper part of the main body 1.

The ironing board 11 is covered with a detachable front cover 15 which includes a mat 14 as a core and a non-fabric cloth covering the mat 14. The ironing board 11 may be slidable by a predetermined length out of the main body 1 or detachable from the main body 1 so that the front cover 15 can be easily replaced by a fresh one.

The housing 5 is provided with a heat shield box 16 made of a heat insulating resin on the side of the ironing board 11 and includes an ironing head rest 17 on which the ironing head 4 is placed temporarily for putting an ironing cloth in order on the worktable 3.

Figure 6A:
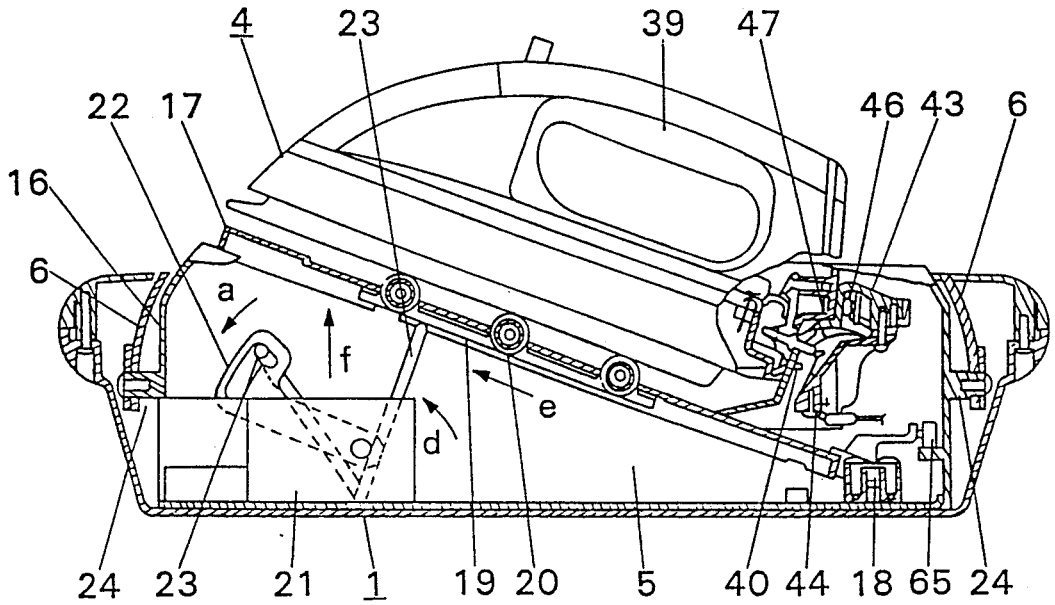
FIG. 6A is a cross-sectional view of the main part of the ironing head in use.
Figure 6B:
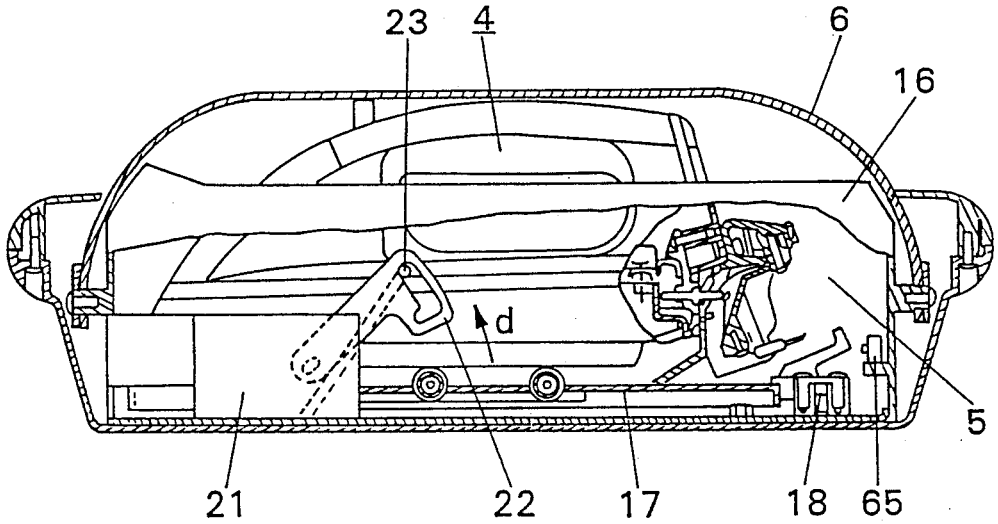
FIG. 6B is a cross-sectional view of the main part of the ironing head accommodated in the housing.
Figure 7A:
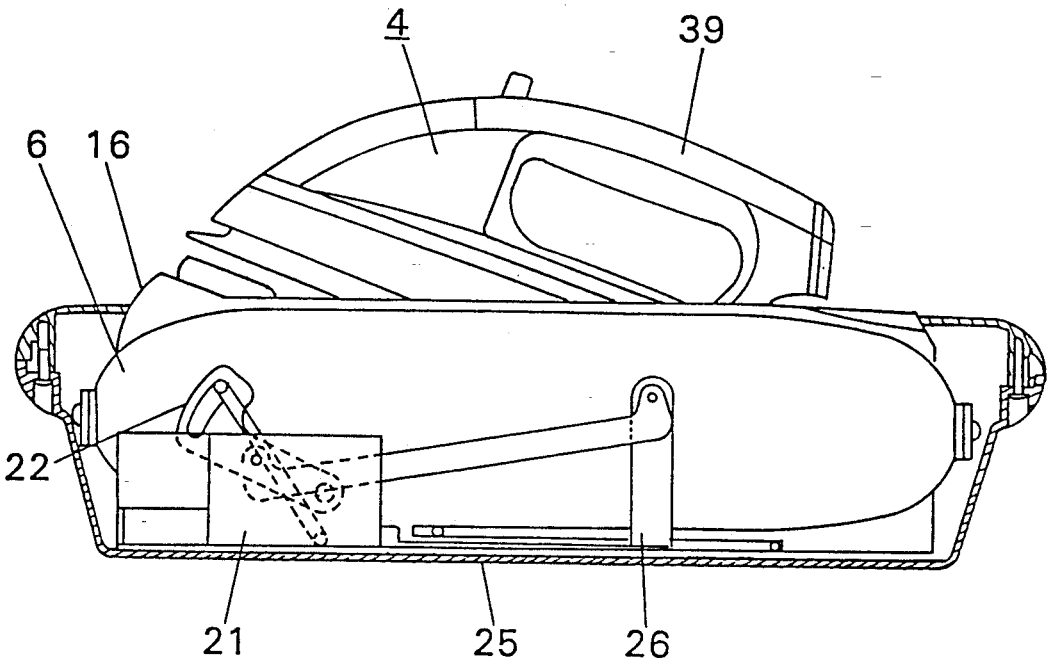
FIG. 7A is a cross-sectional side view of the main part of the ironing head when the housing is opened with the ironing head therein.
Figure 7B:
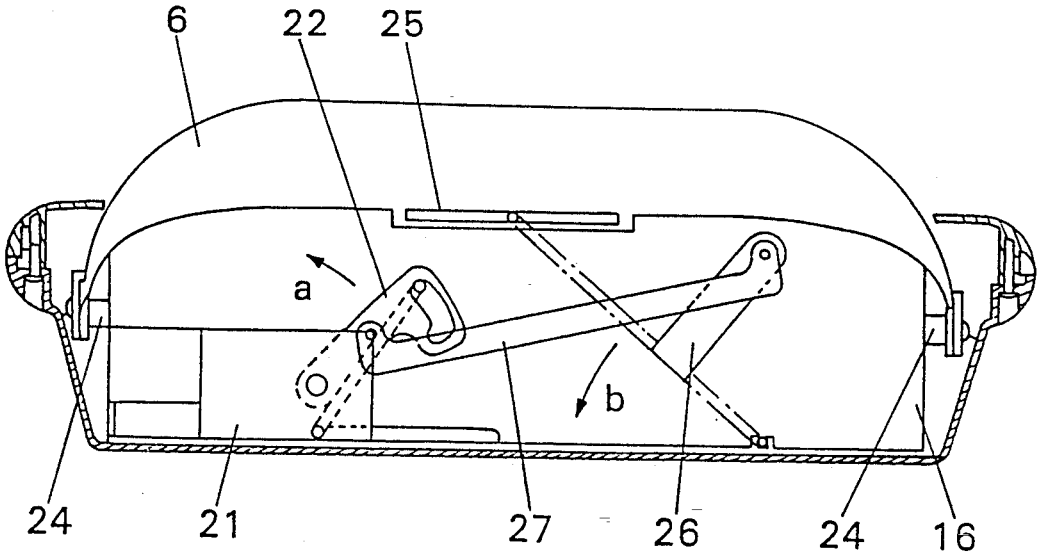
FIG. 7B is a cross-sectional side view of the main part of the ironing head when the housing is closed.
Figure 8:
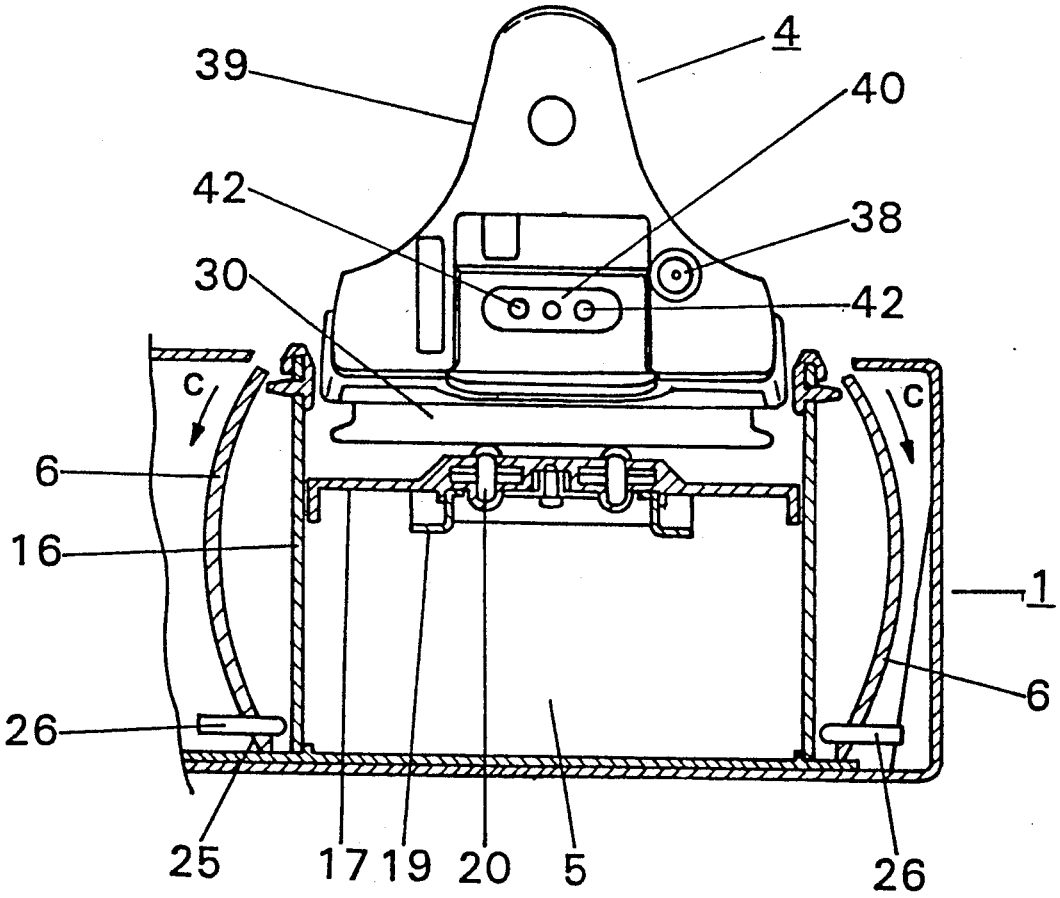
FIG. 8 is a cross-sectional side view of the main part of the ironing head when the housing is opened.

The ironing head rest 17 is made of resin having heat resistance to the ironing head 4 which is heated at elevated temperatures, and, as shown in FIG. 6A, is rotatably fixed by a pivot 18 at one end to the bottom of the housing 5. A plurality of equally spaced rollers 20 are rotatably provided between the ironing head rest 17 and a slide receiving member 19.

When the ironing head 4 is placed on the ironing head rest 17, the ironing head 4 can be supported by the rollers 20 with a predetermined space between the ironing head rest 17 and the ironing head 4 which is slidable on the rollers 20.

The ironing head rest 17 is caused to ascend and descend by means of an electric driving mechanism 21 which includes a motor and a reduction gear, and is rotatable around the pivot 18 as the center along the back surface of the slide receiving member 19 in response to the motion of a rod-type crank cam 23 connected to a cam plate 22 which is driven by the electric drive mechanism 21.

The ironing head 4 housed in the housing 5 is raised to a take-up position in a tilted position with the front portion thereof upward in accordance with the rising motion of the rod-type crank cam 23. The crank cam 23 can be reversely operated so as to cause the ironing head 4 to be restored to its horizontal position in the housing 5. After use, the ironing head 4 still remains hot, and the housing 5 is surrounded with a heat shield box 16. The heat shield box 16 is elliptical, and is provided with axes 24 on the opposite end faces thereof.

The housing cover 6 is composed of a pair of portions pivotally supported by the axes 24, and covers the ironing head 4 as a whole. As shown in FIG. 7, each portion of the housing cover 6 is provided with a groove 25 designed to receive a rod cam 26 fitted therein. The rod cam 26 is connected to a connecting plate 27 rotatably connected to the cam plate 22.

Therefore, the housing cover 6 is operated in accordance with the ascent and descent of the ironing head rest 17 which is caused to ascend and descend by the electric drive mechanism 21, thereby closing and opening the housing 5.

The ironing head 4 includes an aluminum alloy sole 30 which constitutes a vaporizer 29 closed with a cover portion 28, a built-in heater 31 for heating the sole 30, a thermal sensor 32 such as a thermistor for detecting the temperature of the sole 30, a sub-tank 34 connected to the vaporizer 29 via a conduit 33, a water volume detection means 36 for detecting the amount of the water in the sub-tank 34 by an electrode 35, a valve 38 for opening and closing the conduit opening 37 to control the supply of water to the sub-tank 34, and a plastic-made handle 39 operably associated with the valve 38.

The ironing head 4 includes a signal processor 41, which is housed in the handle 39 so as to receive signals from the thermal sensor 32 and the water volume detection means 36 and output to a signal terminal 40, and two electric current supply pins 42 connected to the heater 31.

The ironing head rest 17 includes an electric connector 43 in the rear portion thereof which is connected to terminals 44 connected to the signal terminal 40 and the current supply pins 42. Near the electric connector 43 is provided a water supply valve unit 45 which is connectable to the valve 38 when the ironing head 4 is placed on the ironing head rest 17 and a load detection means 46 for detecting the placement of the ironing head 4 on the ironing head rest 17.

The load detection means 46 includes a reed switch which is operated by a magnet 47 provided on the rear inside surface of the handle 39 so as to detect whether the ironing head 4 is placed on the ironing head rest 17 or removed therefrom. In this way, the load detection means 46 outputs signals, when the ironing head 4 is placed on the ironing head rest 17, the signal terminal 40 and the pins 42 are connected to the terminals 44, and the valve 38 is connected to the water supply valve unit 45, or when these connections are cut off.

The water supply unit 8 including an electric pump is disposed in a channel 48 which connects the main tank 7 detachably provided to the main body 1 and the water supply valve unit 45 provided to the ironing head rest 17. This water supply unit 8 supplies water in the main tank 7 to the water supply valve unit 45 and the sub-tank 34 of the ironing head 4 via the channel 48 and the valve 38, respectively. The water supply unit 8 is operated in response to an output of the load detection means 46 when the ironing head 4 on the ironing head rest 17.

The amount of water in the sub-tank 34 is detected by the water volume detection means 36 including a couple of electrodes 35 having different lengths. If the level of the water falls below the predetermined amount, water is supplied by driving the water supply unit 8 until the level of water reaches a determined height, and the water supply unit 8 is stopped by a signal from the water volume detection means 36. Since a desired amount of water is constantly supplied every time the ironing head 4 is placed on the ironing head rest 17, a sufficient amount of water is kept in the sub-tank 34 of the ironing head 4, thereby eliminating the necessity of having a large capacity. Thus the ironing head 4 can be kept small with a capacity of only 20 ml. Thus the ironing head 4 is reduced in size and weight.

Therefore, when the ironing head 4 is absent on the ironing head rest 17, the water supply unit 8 is stopped under the control of the load detection means 46, and every time the ironing head 4 is placed on the ironing head rest 17, a predetermined amount of water is supplied in response to a signal from the water volume detection means 36.

Figure 9A:
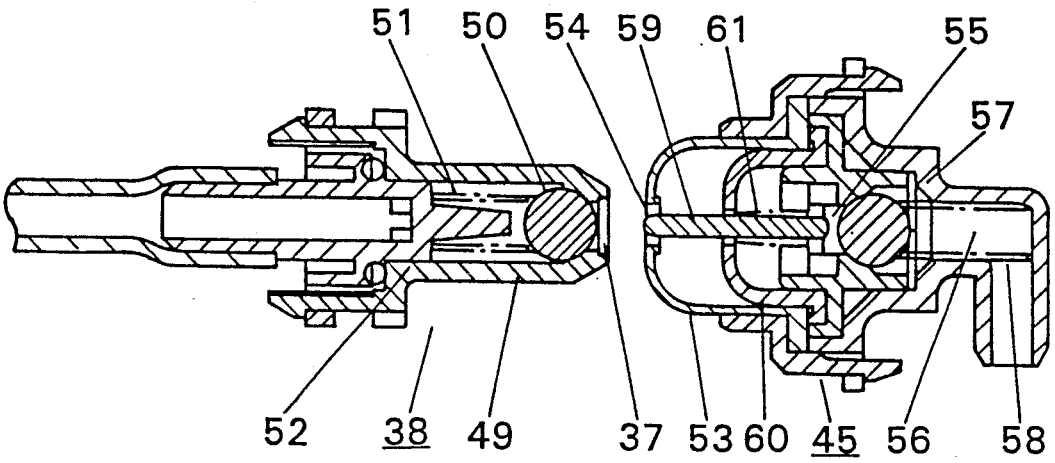
FIG. 9A is an enlarged cross-sectional view of the ironing apparatus in which a valve unit and a water supply counter valve are disengaged from each other.
Figure 9B:
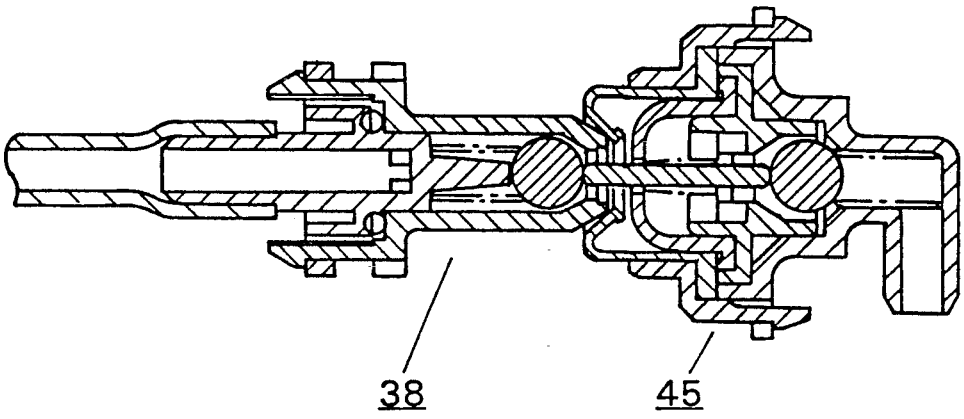
FIG. 9B is an enlarged cross-sectional view of the ironing apparatus in which a valve unit and a water supply counter valve are engaged with each other.
Figure 10:
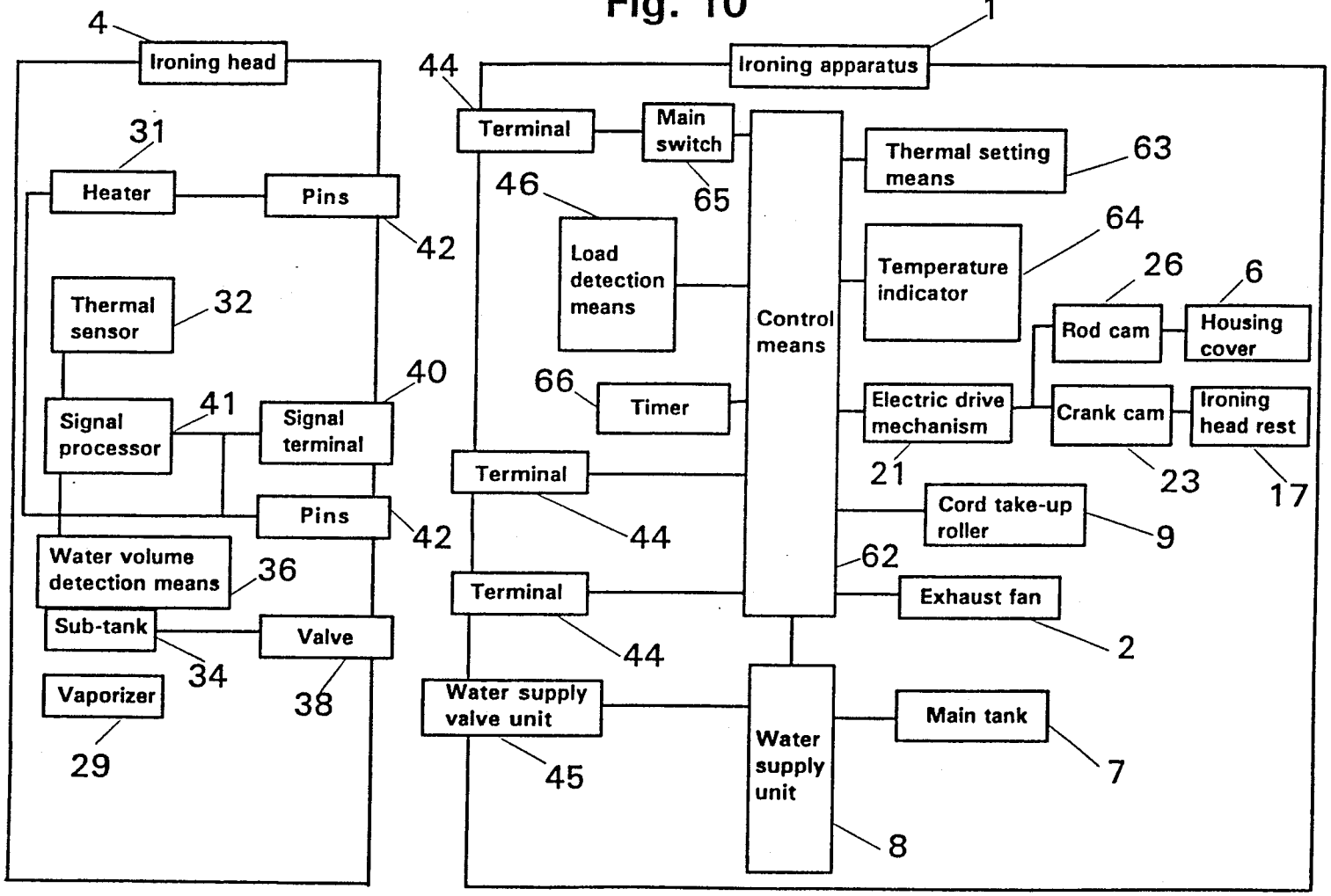
FIG. 10 is a block diagram showing each component constituting the ironing apparatus of FIG. 1.
Figure 11:
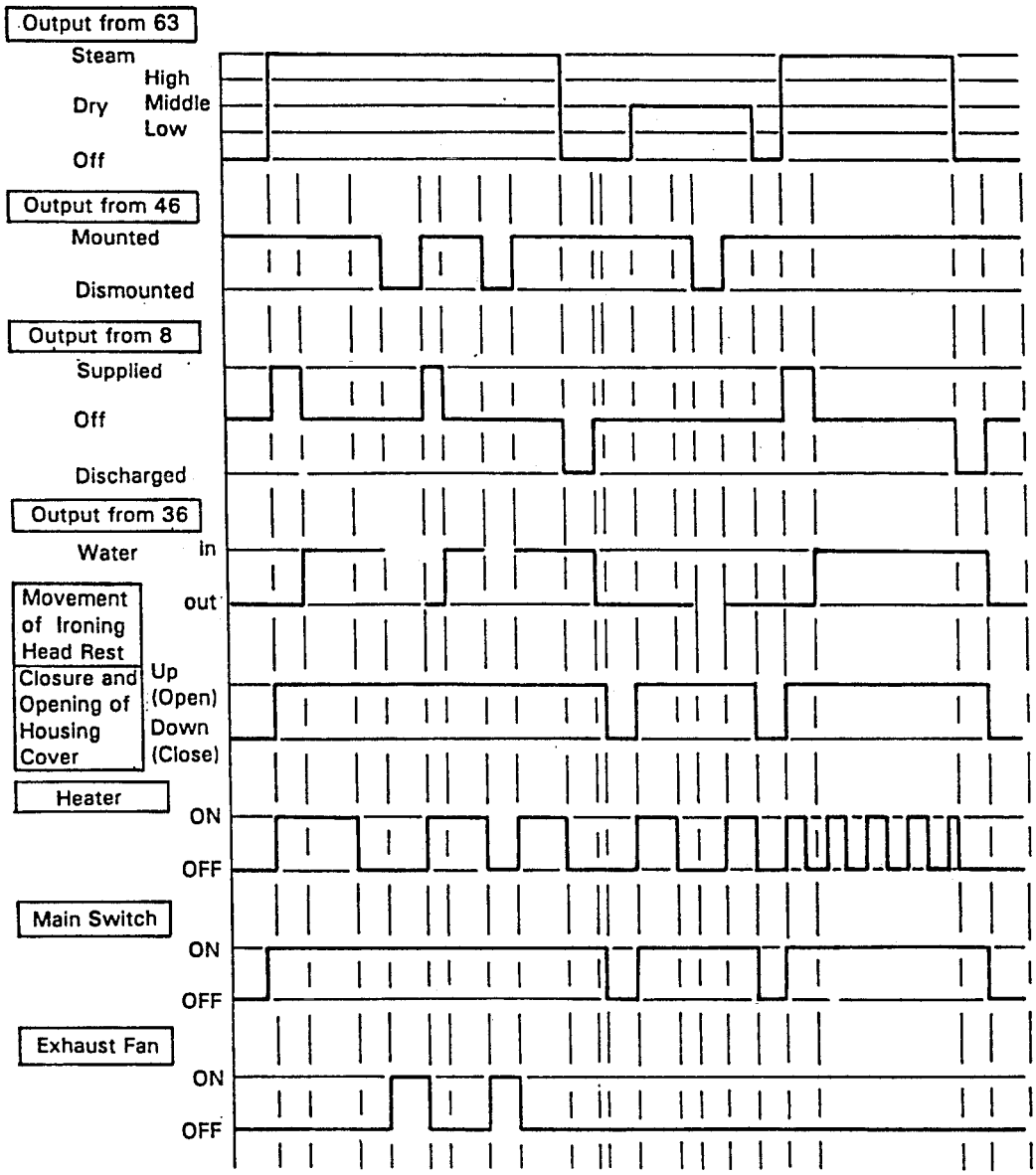
FIG. 11 is a timing chart showing a sequence of operation.

The valve 38 and the water supply valve unit 45 will now be described in greater detail:

Referring to FIGS. 9A and 9B, the valve 38 comprises a channel 49 having a conduit opening 37, a ball 50 movably provided in the channel 49, a spring 51 for pressing the ball 50 against the conduit opening 37 so as to close it, and a regulator 52 to control the ball 50 to move over a predetermined distance.

The water supply valve unit 45 comprises a packing 53 to effect a liquid tight connection to the channel 49, a channel 56 having a water supply opening 54 and an opening 55, a ball 57 movably provided in the channel 56, a spring 58 for pressing the ball 57 against the opening 55 so as to close it, an open/close stem 59, a guide 60 for supporting the open/close stem 59 movably and a spring 61 for loading the open/close stem 59 forward. The outside diameter of the open/close stem 59 is smaller than the inside diameter of the opening 55 of the channel 56, thereby enabling the open/close stem 59 to move freely into the opening 55.

When the ironing head 4 is absent on the ironing head rest 17, the conduit opening 37 of the channel 49 and the opening 55 of the channel 56 are closed by the balls 50 and 57, respectively.

When the ironing head 4 is placed on the ironing head rest 17, the top and of the valve 38 comes into liquid tight contact with the packing 53. Then, the top end of the open/close stem 59 comes into engagement with the ball 50. The open/close stem 59 does not move by the support of the spring but the ball 50 is moved until it touches the top end of the regulator 52, because the strength of the open/close axis spring 61 is larger than that of the spring 51. At this stage, the valve 38 of the ironing head 4 is completely open, but the water supply valve unit 45 on the side of the ironing head rest 17 remains closed.

The open/close stem 59 is moved by the regulator 52 of the valve 38 and the ball 50 until the other end thereof comes into engagement with the ball 57, which is then pushed backward. After moving forward by a predetermined distance, the ball 57 of the water supply valve unit 45 opens the opening 55 completely, thereby allowing the passage of water through the channel 48.

When the ironing head 4 is dismounted from the ironing head rest 17, the procedure is reversely followed. That is, the water supply valve unit 45 on the side of the ironing head rest 17 is closed first, and then the valve 38 on the side of the ironing head 4 is closed. Finally the liquid tight connection between them is released. Therefore, even when the ironing head 4 is slowly placed on the ironing head rest 17 thereby allowing water to be supplied before the liquid tight connection is effected, or when the ironing head is slowly dismounted from the rest 17 during the water supply, there is no worry about water leakages because the ball 57 of the water supply valve unit 45 closes the channel 48. This is also guaranteed by the operation of the load detection means 46.

A control means 62 comprises a plurality of electronic elements for controlling the energizing to the heater 31 in response to an output signal from the signal processor 41. The control means 62 also controls the driving of the water supply unit 8 and the electric drive mechanism. The reference numerals 63 and 64 denote a thermal setting means for setting the optional temperature of the sole 30 and a temperature indicator for showing the state of the set temperature by an LED, etc., respectively.

The reference numeral 65 denotes a main switch for controlling the energizing of the ironing head 4, which is disposed in the rear portion of the ironing head rest 17, and is turned on or off in response to the movement of the ironing head rest 17. When the ironing head rest 17 lowers and the ironing head 4 is housed in the housing 5, no current is supplied to the heater 31 of the ironing head 4. When the ironing head 4 is raised to the upward position in the housing 5, the heater 31 is ready to be energized.

The reference numeral 66 denotes a timer which starts to measure time from the moment when the ironing head 4 is placed on the ironing head rest 17. The timer 66 stops the energizing of the heater 31 when the ironing head 4 is present on the rest 17 for a predetermined period of time, which is normally set to be long enough to prevent interruption of the current supply from occurring every time the ironing head 4 is placed on the ironing head rest 17. When the timer 66 is turned on, the water supply unit 8 is reversely rotated so as to interrupt the current supply to the heater 31, and enables the water remaining in the sub-tank 34 to return to the main tank 7. Finally, the electric drive mechanism 21 is operated so as to enable the ironing head 4 to be housed in the housing 5.

The operation of the ironing apparatus will now be described by reference to FIGS. 6A, 6B, 7A and 7B:

The main body 1 is brought from a tool shed or the like, and assembled at a desired place. The cord is drawn out of the cord take-up roller 9 and the main switch 65 is turned on. The temperature of the ironing head 4 is set to a desired value by using the thermal setting means 63, the cam plate 22 is rotated in the direction of the arrow a by driving the electric drive mechanism 21, and then the rod cam 26 is rotated in the direction of arrow b via the connecting plate 27 connected thereto.

The housing cover 6 is moved in the direction of arrow c, thereby enabling the two portions to displace from each other around the axes 24 of the heat shield box 16. At the same time, the rod-type crank cam 23 connected to the cam plate 22 is rotated in the direction of arrow d, thereby moving the bottom surface of the slide receiving member 19 in the direction of arrow d.

Thus, the ironing head rest 17 is made to ascend up to a position for use in the direction of arrow f so that the ironing head 4 housed in the housing 5 is raised with the front portion thereof higher than the rear portion. In this way the opening of the housing cover 6 and the rising of the ironing head rest 17 occur simultaneously under the linked action of the electric drive mechanism 21.

When the ironing head 4 is supported in a tilted position with its front end higher than its rear end, the main switch 65 is turned on and the ironing head 4 is ready to be energized, the signal terminal 40 and the pins 42 are electrically connected to the respective current supply terminals 44, and the valve 38 and the water supply valve unit 45 are connected to each other. The load detection means 46 detects the placement of the ironing head 4 on the ironing head rest 17.

Then the signal processor 41 outputs a signal to the control means 62 through the signal terminal 40 in response to an output from the thermal sensor 32. The heater 31 is energized through the pins 42 and the current supply terminal 44 in response to a signal output by the control means 62. The water volume detection means 36 detects the amount of water in the sub-tank 34 and outputs a signal, in response to which the control means 62 drives the water supply unit 8 upon reception of an output signal of the signal processor 41 via the signal terminal 40.

If the level of water in the sub-tank 34 does not reach a predetermined level, the supply of water is initiated and continued by the water supply unit 8 until it reaches the predetermined level. Meantime, the sole 30 is heated to a predetermined temperature, and maintained at this temperature. The sub-tank 34 is filled with a predetermined amount of water, and the ironing head 4 is ready to be used.

In this way, water is supplied into the ironing head 4 every time it is placed on the ironing head rest 17. The water in the sub-tank 34 is constantly replenished with water after it is consumed in each ironing operation. This is guaranteed by the structure in which the water is replenished every time it is removed from the ironing head rest 17.

When steaming is used, a temperature suitable for steaming is set by the thermal setting means 63. The ironing head 4 is supplied with electric current and water at the same time when the predetermined temperature is reached. The steam is temporarily stopped manually by pressing the steam button 67 on the ironing head 4. When no steam is used (dry ironing), a desired temperature is set by the thermal setting means 63, so as to keep the water supply unit 8 out of operation even when the ironing head 4 is placed on the ironing head rest 17.

When the ironing head 4 is used after it is removed from the ironing head rest 17 and disconnected from the source of power, the water in the sub-tank 34 is sent to the vaporizer 29 via the conduit 33, thereby dispersing an atomized steam through the sole 30. When the ironing head 4 is dismounted from the ironing head rest 17, the load detection means 46 detects the absence of the ironing head 4, and starts the control means 62 so as to operate the fan 2, which absorbs and discharges the atomized steam to the outside. Thus, clothing is protected from wrinkles being formed by staying steam. The fan 2 is not in operation when steaming is not carried out.

If the ironing head 4 is inadvertently dismounted during the operation of the water supply unit 8, the water supply unit 8 is immediately stopped in response to an output signal from the load detection means 46, thereby protecting the water supply unit 8 against being overloaded. Because of the closing of the water supply valve unit 45, no leakage of water occurs from the joint to the valve 38. Therefore, the user is relieved from the trouble of paying special attention to the timing and the speed of mounting and dismounting the ironing head 4 on and from the ironing head rest 17.

When the ironing head 4 is mounted on the ironing head rest 17 and the handle 39 is released from the user's hands, the ironing head 4 slides downward on and along the rollers 20 by force of gravity. There is no need for adjusting the position of the ironing head 4 so as to secure the connection. The load detection means 46 detects the placement of the ironing head 4 on the ironing head rest 17, and the signal terminal 40 and the current supply pins 42 are connected to the current supply terminals 44, the valve 38 and the water valve unit 45 are connected, thereby supplying water to the sub-tank 34 and energizing the heater 31.

If the ironing head 4 is inappropriately placed on the ironing head rest 17, neither the supplying of water nor the supplying of current occurs. Therefore, fire hazards or injury to the human body is avoided.

When ironing is finished, the supply of current to the ironing head 4 is stopped by turning off the thermal setting means 63. At the same time, the water supply unit 8 is reversely rotated so as to discharge the remaining water in the sub-tank 34 to the main tank 7. After being reversely rotated for a predetermined period of time, the electric drive mechanism is driven in the opposite direction to that at the start and the ironing head 4 is made to descend together with the ironing head rest 17. In this way, the ironing head 4 is horizontally housed in the housing 5, and closed with the housing cover 6.

In this way the ironing head 4 heated to an elevated temperature is safely housed even immediately after ironing. Even if the ironing head 4 is left on the ironing head rest 17 with its power on, the energizing of the ironing head 4 is stopped upon lapsing of a time set by the timer 66 as is the case with turning off the apparatus. Then the water remaining in the sub-tank 34 is discharged into the main tank 7 by the water supply unit 8 and the ironing head 4 is housed in the housing by the electrical drive mechanism 21.

In the illustrated embodiment, the ironing head 4 is raised in a tilted position with its front end higher than the rear end. It is possible to arrange it so that the angle of decline is produced as desired. Instead of the arrangement under which the thermal setting means 63 has a priority to control the temperature of the ironing head 4, other systems can be utilized other than the thermal setting means 63 so as to control the mounting and dismounting of the ironing head 4.

It is understood that various other modifications will be apparent to and can be readily made by those skilled in the art without departing from the scope and spirit of this invention. Accordingly, it is not intended that the scope of the claims appended hereto be limited to the description as sat forth herein, but rather that the claims be construed as encompassing all the features of patentable novelty that reside in the present invention, including all features that would be treated as equivalents thereof by those skilled in the art to which this invention pertains.

What is claimed is:

1. An ironing apparatus, comprising:

an ironing head, an ironing head rest for placement of the ironing head thereon, an electrical connection for supplying an electric current to the ironing head when said ironing head is placed on the ironing head rest, a main tank for containing water, a water supply unit for supplying water from the main tank to the ironing head, a control means for controlling the water supply unit, a load detection means for detecting the placement of the ironing head on the ironing head rest, wherein the control means causes the water supply unit to supply water to the ironing head when said load detection means detects the placement of the ironing head on the ironing head rest, and wherein the ironing head comprises:

a sub-tank for holding the water supplied to the ironing head, a water volume detection means for detecting an amount of the water in the sub-tank, and said control means comprising means for deactivating said water supply unit in response to an output provided from the water volume detection means when the sub-tank is filled with a predetermined amount of the water.

2. The ironing apparatus according to claim 1, wherein:

the ironing head comprises an ironing head valve for opening and closing an ironing head opening formed therein, and the ironing head rest comprises a water supply valve for opening and closing a water supply opening formed therein, the ironing head and water supply valves affecting a fluid connection and disconnection between the ironing head and the water supply means, and wherein the placement of the ironing head on the ironing head rest operates means for opening the ironing head and water supply valves, and the dismount of the ironing head from the ironing head rest operates means for closing the ironing head and water supply valves.

3. The ironing apparatus according to claim 1, further comprising:

a temperature controller, a thermal sensor for sensing a temperature of said ironing head, wherein the temperature controller causes the ironing head to be energized in response to an output from the thermal sensor, a thermal setting means for setting a preselected temperature of the ironing head, and wherein said control means comprises means for controlling the supply of water to the iron head as a function of an output from the thermal setting means.

4. The ironing apparatus according to claim 3, further comprising means for returning the water in the ironing head to the main tank in response to an output from the thermal setting means when the ironing head is deenergized as a function of the thermal setting means.

5. An ironing apparatus, comprising:

an ironing head, an ironing head rest for placement of the ironing head thereon, an electrical connection for supplying an electric current to the ironing head when said ironing head is placed on the ironing head rest, a main tank for containing water, a water supply unit for supplying water from the main tank to the ironing head, a control means for controlling the water supply unit, a load detection means for detecting the placement of the ironing head on the ironing head rest, wherein the control means causes the water supply unit to supply water to the ironing head when said load detection means detects the placement of the ironing head on the ironing head rest, and a timer for measuring time from a moment when the ironing head is placed on the ironing head rest whereby upon lapsing of a predetermined time current being supplied to the ironing head is interrupted and the water supply unit returns the water in the sub-tank to the main tank.

6. An ironing apparatus, comprising:

an ironing head, an ironing head rest for placement of the ironing head thereon, an electrical connection for supplying an electric current to the ironing head when said ironing head is placed on the ironing head rest, a main tank for containing water, a water supply unit for supplying water from the main tank to the ironing head, a control means for controlling the water supply unit, a load detection means for detecting the placement of the ironing head on the ironing head rest, wherein the control means causes the water supply unit to supply water to the ironing head when said load detection means detects the placement of the ironing head on the ironing head rest, and wherein the ironing head rest comprises:

a housing for housing the ironing head, a housing cover for covering the ironing head housed in the housing, said housing cover comprising two movable portions, and an electric drive mechanism for opening and closing said portions.

7. The ironing apparatus according to claim 6, further comprising:

a current control means for controlling a current supply to the ironing head in response to an output from a thermal detection means, and a thermal setting means for setting a temperature of the ironing head to a preselected value, said electric drive mechanism being responsive to an output from the thermal setting means.

8. The ironing apparatus according to claim 6, further comprising:

a timer for measuring time from a moment when the ironing head is placed on the ironing head rest, wherein upon lapsing of a predetermined amount of time current being supplied to the ironing head is interrupted, and the electric drive mechanism is actuated to close the movable portions of the housing cover, thereby securing the ironing head inside the housing.

9. The ironing apparatus according to claim 6, wherein the electric drive mechanism comprises means for raising and lowering a portion of the ironing head rest, the descent and ascent of the ironing head rest being generally simultaneous with movement of the housing cover.

10. The ironing apparatus according to claim 9, wherein the ironing head is raised to a tilted position with a front portion of the ironing head higher than a rear portion of the ironing head, and is lowered to a horizontal position when housed in the housing.

11. The ironing apparatus according to claim 6, further comprising a switch for deactivating the current supply to the ironing head when said movable portions are closed, and for activating the current supply to the ironing head when said movable portions are open.

12. An ironing apparatus, comprising:

an ironing head, an ironing head rest for placement of the ironing head thereon and for supplying an electric current to the ironing head when placed thereon, a main tank for containing water, a water supply unit for supplying water from the main tank to the ironing head, a load detection means for detecting the placement of the ironing head on the ironing head rest, a control means for controlling the water supplied to the ironing head, the water supply unit being driven in response to an output from the load detection means, a housing for housing the ironing head, a movable housing cover for covering the ironing head housed in the housing, and an electric drive mechanism for closing and opening the housing cover.

13. The ironing apparatus according to claim 12, further comprising means for descending and ascending a portion of the ironing head rest, said descending and ascending means activated by the electric drive mechanism, the descending and ascending movements of the ironing head rest being generally simultaneous with the opening and closing of the housing cover.

14. An ironing apparatus, comprising:

an ironing head, an ironing head rest for placement of the ironing head thereon and for supplying an electric current to the ironing head when placed thereon, a main tank for containing water, a water supply unit for supplying water from the main tank to the ironing head, a load detection means for detecting the placement of the ironing head on the ironing head rest, a control means for controlling the water supplied to the ironing head, the water supply unit being driven in response to an output from the load detection means, a housing for housing the ironing head, a movable housing cover for covering the ironing head housed in the housing, means for activating said housing cover to house the ironing head in the housing in response to the operation of an electric drive mechanism, and an ironing table on which ironing of articles is carried out.

15. An ironing apparatus, comprising:

an ironing head including a sub-tank, an ironing head rest for placement of the ironing head thereon, a main tank for containing water, a water supply unit for transferring water between the main tank and the sub-tank when said ironing head is placed on said ironing head rest, a control means for causing the water supply unit to automatically supply water to the ironing head during an ironing operation, and for causing the water supply unit to automatically return water from the sub-tank to the main tank upon completion of an ironing operation.

16. The ironing head according to claim 15, further comprising a timer for measuring an elapsed time that said ironing head remains placed on the ironing heat rest, whereby upon a lapsing of a predetermined amount of time the water supply unit returns the water in the sub-tank to the main tank.

17. An ironing apparatus, comprising:

an ironing head;

an ironing head rest for placement of the ironing head thereon;

a housing for housing the ironing head on said ironing head rest;

a movable housing cover for covering the ironing head in the housing when in a closed position and for exposing the ironing head in the housing when in an open position; and an electric drive mechanism for closing and opening the housing cover, means for raising the ironing head to a tilted position with a front portion of the ironing head higher than a rear portion of the ironing head when the housing cover is moved from the closed position to the open position.

18. The ironing apparatus according to claim 17, wherein the electric drive mechanism comprises means for raising and lowering a portion of the ironing head rest within said housing.

19. The ironing apparatus according to claim 18, wherein the descent and ascent of the ironing head rest is generally simultaneous with the movement of the housing cover.

* * * * *